US006726855B1

(12) United States Patent
Migdal et al.

(10) Patent No.: US 6,726,855 B1
(45) Date of Patent: Apr. 27, 2004

(54) LUBRICANT COMPOSITIONS COMPRISING MULTIPLE ANTIOXIDANTS

(75) Inventors: Cyril A. Migdal, Pleasant Valley, NY (US); Ronald D. Abbott, Winsted, CT (US)

(73) Assignee: Uniroyal Chemical Company, Inc., Middlebury, CT (US)

( * ) Notice: Subject to any disclaimer, the term of this patent is extended or adjusted under 35 U.S.C. 154(b) by 326 days.

(21) Appl. No.: 09/203,894

(22) Filed: Dec. 2, 1998

(51) Int. Cl.[7] ..... C09K 15/18
(52) U.S. Cl. ..... 252/401; 508/261
(58) Field of Search ..... 508/261; 252/401, 252/403

(56) References Cited

U.S. PATENT DOCUMENTS

| | | | | | |
|---|---|---|---|---|---|
| 2,647,824 | A | | 8/1953 | Jones et al. | 252/51.5 R |
| 3,247,111 | A | | 4/1966 | Oberright et al. | |
| 4,158,000 | A | | 6/1979 | Nagasaki et al. | 260/45.8 |
| 4,326,062 | A | | 4/1982 | Kojima et al. | 546/166 |
| 4,374,218 | A | | 2/1983 | Tay | 524/86 |
| 4,692,258 | A | | 9/1987 | Rasberger et al. | 252/51.5 R |
| 4,965,006 | A | | 10/1990 | Meier et al. | 252/51.5 R |
| 5,246,606 | A | | 9/1993 | Evans | 252/51 |
| 5,310,491 | A | | 5/1994 | Downs et al. | |
| 5,498,062 | A | | 3/1996 | Holdampf | 297/238 |
| 5,498,809 | A | | 3/1996 | Emert et al. | 585/13 |
| 5,744,566 | A | * | 4/1998 | Tsutsui et al. | 526/336 |
| 5,880,073 | A | * | 3/1999 | Tomizawa et al. | 508/383 |
| 5,972,854 | A | * | 10/1999 | Ichihashi et al. | 508/433 |
| 6,080,929 | A | * | 6/2000 | Fagouri et al. | 174/23 C |
| 6,121,209 | A | * | 9/2000 | Watts et al. | 508/162 |
| 6,143,702 | A | * | 11/2000 | Nadasdi | 508/550 |
| 6,235,686 | B1 | * | 5/2001 | Karol et al. | 508/261 |
| 6,306,802 | B1 | * | 10/2001 | Shaub | 508/364 |

FOREIGN PATENT DOCUMENTS

| | | | |
|---|---|---|---|
| CA | 943962 | 3/1974 | 260/281.5 |
| JP | 53051206 | 5/1978 | |
| JP | 115493 | * 7/1982 | |
| JP | 57115493 | 7/1982 | |
| PL | PL-172885 | 12/1997 | |

OTHER PUBLICATIONS

Patent Abstract of Japan—"Pressure–Sensitive Adhesive Composition for Protecting Surface of Decorative Article" by Okido Masaharu Publication No 55071769 Publication Date May 30, 1980.

Patent Abstract of Japan—entitled "Rubber Composition" by Tado Kazuhiro Publication No 57085835 Publication Date May 28, 1982.

* cited by examiner

*Primary Examiner*—Peter Szekely
(74) *Attorney, Agent, or Firm*—Michael P. Dilworth

(57) ABSTRACT

A composition is disclosed that comprises lubricating oil and at least a first antioxidant and a second antioxidant, the first antioxidant being a secondary diarylamine and the second antioxidant being a 2,2,4-trialkyl-1,2-dihydroquinoline or a polymer thereof. Also disclosed is a method of increasing the oxidation stability of a lubricating oil comprising adding thereto at least a first antioxidant and a second antioxidant, the first antioxidant being a secondary diarylamine and the second antioxidant being a 2,2,4-trialkyl-1,2-dihydroquinoline or a polymer thereof.

9 Claims, No Drawings

LUBRICANT COMPOSITIONS COMPRISING MULTIPLE ANTIOXIDANTS

BACKGROUND OF THE INVENTION

1. Field of the Invention

The present invention is related to the improvement in oxidation stability of lubricating oils and, more particularly, to the oxidation stability of mineral oil and polyol ester base oils by a combination of at least two antioxidants.

2. Description of Related Art

Lubricating oils, as used in the internal combustion engines of automobiles, trucks, trains, ships, and aircraft, are subjected to a demanding environment during use. This environment results in the oxidation of the oil, which oxidation is catalyzed by impurities that are present in the oil, e.g., iron compounds, and further promoted by the elevated temperatures that arise during use. This oxidation of lubricating oils during use is usually controlled, at least to some extent, by the addition of antioxidants that may extend the useful life of the oil.

Lubricant compositions containing various secondary diarylamines are widely known in the art. The use of 2,2,4-trimethyl-1,2-dihydroquinoline polymers is also known, although to a lesser extent.

JP 53051206 (May 10, 1978) discloses 2,2,4-trimethyl-1,2-dihydroquinoline polymer as a useful antioxidant for ester or mineral oil based lubricating oils that also contain disulfides.

JP 57115493 (Jul. 17, 1982) discloses 2,2,4-trimethyl-1,2-dihydroquinoline polymer as a useful antioxidant for lubricating oils.

JP 53051206 (Dec. 24, 1984) discloses 2,2,4-trimethyl-1,2-dihydroquinoline homopolymer as a useful antioxidant for polyol ester based lubricating oils in combination with thiobisphenols.

Polish PL-172885 (Dec. 31, 1997) discloses that poly (2,2,4-trimethyl-1,2-dihydroquinoline) is useful in a transmission oil to decrease copper corrosion.

U.S. Pat. No. 4,158,000 discloses antidegradants for rubber comprising a mixture consisting essentially of 2,2,4-trimethyl-1,2-dihydroquinoline monomer, dimer thereof, and more highly polymerized products than the dimer, the contents of the quinoline monomer and the quinoline dimer being less than 5 percent by weight and 25 percent by weight or more, respectively. The antidegradants for rubber are said to be useful for preventing both heat aging and flex cracking of rubber.

U.S. Pat. No. 4,326,062 discloses that 2,2,4-trimethyl-1,2-dihydroquinoline polymer containing 25 percent by weight or more of the dimer is effectively prepared by the polymerization of 2,2,4-trimethyl-1,2-dihydroquinoline monomer in the presence of hydrochloric acid, the concentration of hydrochloric acid being from 15 to 25 percent by weight, and the amount of hydrochloric acid being 0.2 to 0.5 mole per mole of the total of the monomer and impurity amines contained in the monomer. The polymer is said to be useful as an antioxidant for rubber.

U.S. Pat. No. 4,374,218 discloses that rubber compositions containing, inter alia, poly(2,2,4-trimethyl-1,2-dihydroquinoline) exhibit a combination of properties especially suited for use as fluid sealing elements, such as valve seals, piston seals, washers, and faucet seats.

Canadian Patent No. 943,962 discloses substituted 1,2-dihydroquinolines that are said to have excellent antioxidant, bactericidal, insecticidal and fungicidal properties and a process and apparatus for their preparation.

The disclosures of the foregoing are incorporated herein by reference in their entirety.

SUMMARY OF THE INVENTION

It has now been discovered that a combination of a secondary diarylamine and a 2,2,4-trialkyl-1,2-dihydroquinoline or polymer thereof is highly effective in inhibiting oxidation in lubricating oil compositions. The 2,2,4-trialkyl-1,2-dihydroquinoline polymer acts synergistically with secondary diarylamines to provide significant improvement in oxidation control.

More particularly, the present invention is directed to a composition comprising lubricating oil and at least a first antioxidant and a second antioxidant, the first antioxidant being a secondary diarylamine and the second antioxidant being a 2,2,4-trialkyl-1,2-dihydroquinoline or a polymer thereof.

In another aspect, the present invention is directed to a method of increasing the oxidation stability of a lubricating oil comprising adding thereto at least a first antioxidant and a second antioxidant, the first antioxidant being a secondary diarylamine and the second antioxidant being a 2,2,4-trialkyl-1,2-dihydroquinoline or a polymer thereof.

DESCRIPTION OF THE PREFERRED EMBODIMENTS

The ratio of the secondary diarylamine to the 2,2,4-trialkyl-1,2-dihydroquinoline or polymer thereof in the mixture employed in the lubricating oil compositions of the present invention can be in substantially all proportions. Preferably, the ratio of secondary diarylamine to 2,2,4-trialkyl-1,2-dihydroquinoline polymer will be in the range of 1:99 to 99:1, more preferably, about 90:10 to about 10:90 parts by weight. The secondary diarylamine may be in the lubricating oil composition in a range of about 0.01 to about 10 weight percent, and preferably about 0.1 to about 5 weight percent. The 2,2,4-trialkyl-1,2-dihydroquinoline or polymer thereof also may be in the lubricating oil composition in a range of about 0.01 to about 10 weight percent, and preferably about 0.1 to about 5 weight percent.

The secondary diarylamines are well known antioxidants, and there is no particular restriction on the type of secondary diarylamine that can be used in the practice of this invention. Preferably, the secondary diarylamine antioxidant is one of the formula $R_1$—NH—$R_2$ where $R_1$ and $R_2$ each independently represent a substituted or unsubstituted aryl group having from 6 to 46 carbon atoms. Illustrative of substituents for the aryl moieties are aliphatic hydrocarbon groups, such as alkyl of 1 to 40 carbon atoms, hydroxyl, carboxyl, amino, N-alkylated amino, N-arylated amino, N'N-dialkylated amino, nitro, or cyano. The aryl moieties are preferably substituted or unsubstituted phenyl or naphthyl, particularly where one or both of the aryl moieties are substituted with alkyl, such as one having 4 to 24 carbon atoms.

The alkyl moiety, which can be of 1 to 40 carbon atoms, can have either a straight chain or a branched chain, which may be a fully saturated or a partially unsaturated hydrocarbon chain; for example, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof.

Examples of some of the secondary diarylamines that are useful in the practice of the present invention include: diphenylamine, monoalkylated diphenylamine, dialkylated diphenylamine, trialkylated diphenylamine, or mixtures thereof, 3-hydroxydiphenylamine, 4-hydroxydiphenylamine, mono- and/or di-butyldiphenylamine, mono- and/or di-octyldiphenylamine, mono- and/or di-nonyldiphenylamine, phenyl-α-naphthylamine, phenyl-β-naphthylamine, diheptyldiphenylamine, mono- and/or di-(α-methylstyryl)diphenylamine, mono- and/or distyryidiphenylamine, 4-(p-toluenesulfonamido) diphenylamine, 4-isopropoxydiphenylamine, t-octylated N-phenyl-1-naphthylamine, mixtures of mono- and dialkylated t-butyl-t-octyldiphenylamines, N-phenyl-1,2-phenylenediamine, N-phenyl-1,4-phenylenediamine, N,N'-diphenyl-p-phenylenediamine, N,N'-di(naphthyl-2)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, and N-cyclohexyl-N'-phenyl-p-phenylenediamine.

In the 2,2,4-trialkyl-1,2-dihydroquinoline and polymers thereof that are employed as the second antioxidant in the present invention, the trialkyl moiety can comprise any alkyl groups that will not adversely affect the antioxidizing properties of the compound. Typically, the three alkyl groups, which may be the same or different, will be lower alkyl groups, for example those having one to four carbon atoms, i.e., methyl, ethyl, propyl, isopropyl, butyl, and isomers thereof. It is preferred that the trialkyl moiety be trimethyl.

The 2,2,4-trialkyl-1,2-dihydroquinoline of the present invention can include the trimethylquinoline monomer and/or polymeric mixtures illustrated by the structure:

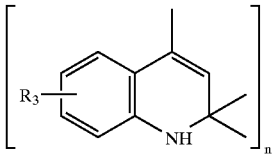

where n in an integer of 1 to 1000 and $R_3$ is hydrogen, alkyl, or alkoxy. Preferably, n is an integer of 1 to about 10, in which case they are often referred to as oligomers when n is greater than 1.

An example of the manufacture of 2,2,4-trimethyl-1,2-dihydroquinoline polymers, is disclosed in U.S. Pat. No. 4,326,062 and references cited, the disclosure of which is incorporated herein by reference.

Where $R_3$ is alkyl, it is preferably alkyl of 1 to 20 carbon atoms, e.g., methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadeceyl, eicosyl, and the like, and isomers thereof. Where $R_3$ is alkoxy, similarly it is preferred that the alkyl moiety thereof be of 1 to 20 carbon atoms, e.g., methoxy, ethoxy, propoxy, butoxy, pentoxy, hexoxy, heptoxy, octoxy, nonoxy, decoxy, undecoxy, dodecoxy, tridecoxy, tetradecoxy, pentadecoxy, hexadecoxy, heptadecoxy, octadecoxy, nonadecoxy, eicosoxy, and the like and isomers thereof. Commercially available examples of such species include 6-dodecyl-1,2-dihydro-2,2,4-trimethylquinoline and 6-ethoxy-1,2-dihydro-2,2,4-trimethylquinoline.

The combination of antioxidant additives of this invention can be used in combination with other additives typically found in lubricating oils, as well as other antioxidants. The additives typically found in lubricating oils are, for example, dispersants, detergents, rust inhibitors, antioxidants, metal deactivators, antiwear agents, antifoamants, friction modifiers, seal swell agents, demulsifiers, VI (viscosity index) improvers, pour point depressants, and the like. See, e.g., U.S. Pat. No. 5,498,809 for a description of useful lubricating oil composition additives, the disclosure of which is incorporated herein by reference in its entirety.

Examples of dispersants include polyisobutylene succinimides, polyisobutylene succinate esters, Mannich Base ashless dispersants, and the like. Examples of detergents include metallic phenates, metallic sulfonates, metallic salicylates, and the like. Examples of antioxidants include alkylated diphenylamines, N-alkylated phenylenediamines, hindered phenolics, alkylated hydroquinones, hydroxylated thiodiphenyl ethers, alkylidenebisphenols, oil soluble copper compounds, and the like. Examples of antiwear additives that can be used in combination with the additives of the present invention include organo borates, organo phosphites, organic sulfur-containing compounds, zinc dialkyldithiophosphates, zinc diaryldithiophosphates, phosphosulfurized hydrocarbons, and the like. Examples of friction modifiers include fatty acid esters and amides, organo molybdenum compounds, molybdenum dialkylthiocarbamates, molybdenum dialkyl dithiophosphates, and the like. An example of an antifoamant is polysiloxane and the like. An example of a rust inhibitor is a polyoxyalkylene polyol and the like. Examples of VI improvers include olefin copolymers and dispersant olefin copolymers and the like. An example of a pour point depressant is polymethacrylate and the like.

Lubricant Compositions

Compositions, when they contain these additives, are typically blended into the base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.1–10 | 0.1–5 |
| Lube Oil Flow Improver | 0.01–2 | 0.01–1.5 |
| Detergent/Rust Inhibitor | 0.01–6 | 0.01–3 |
| Pour Point Depressant | 0.01–1.5 | 0.01–0.5 |
| Antifoaming Agent | 0.001–0.1 | 0.001–0.01 |
| Antiwear Agent | 0.001–5 | 0.001–1.5 |
| Seal Swellant | 0.1–8 | 0.1–4 |
| Friction Modifier | 0.01–3 | 0.01–1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and/or by mixing accompanied with mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, about 2.5 to about 90 percent, preferably about 15 to about 75 percent, and more preferably about 25 to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocrackate base stocks produced by hydrocracking (rather than solvent extracting) the aromatic and polar components of the crude. Natural lubricating oils include animal oils, vegetable oils (e.g., rapeseed oils, castor oils, and lard oil), petroleum oils, mineral oils, and oils derived from coal or shale.

Synthetic oils include hydrocarbon oils and halo-substituted hydrocarbon oils, such as polymerized and interpolymerized olefins, alkylbenzenes, polyphenyls, alkylated diphenyl ethers, alkylated diphenyl sulfides, as well as their derivatives, analogs, homologues, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{18}$ monocarboxylic acids and polyols and polyol ethers. These polyol esters are a preferred class of base oils for the present invention. Examples of polyol esters are:

| | |
|---|---|
| $C(CH_2CO_2R)_4$ | Pentaerythritol Esters, |
| $CH_3CH_2C(CH_2CO_2R)_3$ | Trimethylol propane Esters, and |
| $(CH_3)_2C(CH_2CO_2R)_2$ | Neopentylglycol Esters. |

where R is a branched, linear, or mixed alkyl chain, preferably having from 5 to 18 carbon atoms.

The polyol esters are made from the mono acids and multifunctional alcohols. A few of the more commonly used mono acids are valeric acid ($C_5$), heptanoic acid ($C_7$), pelargonic acid ($C_9$), oleic acid ($C_{16}$), and mixtures thereof.

Additional ester base oils that are very similar to the polyol esters and that are also useful in the practice of the present invention include:

1. esters of the diester type, produced from an alcohol and a diacid, e.g., esters of adipic, azelaic, sebacic, dodecanoic, acids;
2. esters of the phthalate type, produced from an alcohol and, e.g., 1,2-benzene dicarboxylic acid or phthalic anhydride;
3. esters of the trimellitate type, produced from an alcohol and, e.g., 1,2,4-benzene tricarboxylic acid or trimellitic anhydride;
4. esters of the pyrotrimellitate type, produced from an alcohol and, e.g., 1,2,4,5-benzene tetracarboxylic acid or pyromellitic anhydride;
5. esters of the dimer acid ester type, produced from an alcohol and, e.g., $C_{36}$ dimer acids or hydrogenated $C_{36}$ dimer acids; and other similar to the foregoing.

Common alcohols that can be used to make the above esters include n-hexanol, isoheptanol, isooctanol, 2-ethyl hexanol, isononyl, isodecanol, tridecanol, and the like.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, rerefined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The lubricating oil used in the practice of the present invention can be an API (American Petroleum Institute) base oil. Such oils are described in the following table.

API Base Oil Categories

| API Category | Percent Saturates | Percent Sulfur | Viscosity Index |
|---|---|---|---|
| Group I | ≦90 | ≧0.03 | ≧80 and ≦120 |
| Group II | ≧90 | ≦0.03 | ≧80 and ≦120 |
| Group III | ≧90 | ≦0.03 | ≧120 |
| Group IV | Poly α-olefin | Poly α-olefin | Poly α-olefin |
| Group V | Other[1] | Other | Other |

[1]Includes all other base oils not included in the first four groups.

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Pressure Differential Scanning Calorimetry Results

The Pressure Differential Scanning Calorimetry (PDSC) data in Table 3 are a measure of the oxidation induction time (OIT) of each blend. The PDSC conditions are given in Table 2. All formulations were blended for 15 minutes under a nitrogen atmosphere. The PDSC method employs a steel bomb under pressure, the catalyst is oil-soluble iron derived from iron naphthenate. At the start of a run, the PDSC cell is initially heated at a rate of 40° C. per minute to the isothermal temperature listed in each results table. The induction time is measured from the time the sample reaches its isothermal temperature until the enthalpy change is observed. The longer the oxidation induction time, the better the oxidation stability of the oil. The PDSC instrument used is a Mettler DSC27HP manufactured by Mettler-Toledo, Inc. The test has a repeatability of ±2.5 minutes with 95 percent confidence for OIT's less than 100 minutes. Each data point is the average of two runs on a single test blend.

TABLE 2

PDSC Test Parameters

| Test | PDSC |
|---|---|
| Temperature | Variable (see data tables) |
| $O_2$ Gas Pressure | 500 psi |
| Flow Through Cell | 100 mL/min. |
| Catalyst | 50 ppm Iron |
| Sample Holder | Open Aluminum Pan |
| Sample Size | 3 mg |
| Induction Time | Enthalpy Change |

TABLE 3

PDSC Results in Polyol Ester Oil Formulation

| Blend | Antioxidant (wt %) | Antioxidant (wt %) | Temp. ° C. | OIT min. |
|---|---|---|---|---|
| 1 | Naugalube® 640 (1.0) | — | 220 | 36.1 |
| 2 | Naugalube TMQ (0.25) | Naugalube 640 (0.75) | 220 | 55.8 |
| 3 | Naugalube TMQ (0.50) | Naugalube 640 (0.50) | 220 | 62.9 |
| 4 | Naugalube TMQ (0.75) | Naugalube 640 (0.25) | 220 | 73.4 |
| 5 | Naugalube TMQ (1.0) | — | 220 | 57.9 |

The data in Table 3 were generated in a polyol ester base oil (Hatcol 3365, Hatco Corporation). The secondary arylamine tested was a complex mixture of octylated and butylated diphenylamines (Naugalube® 640, Uniroyal Chemical Company, Inc.). The 2,2,4-trimethyl-1,2-dihydroquinoline oligomer tested is available commercially from Uniroyal Chemical Company, Inc., and is sold as Naugalube TMQ. The OIT measurements of blends 3 and 4 demonstrate the superior oxidation stability of mixtures of the two antioxidants. The total amount of antioxidant in each blend was 1 weight percent. Each blend was tested under the conditions described in Table 2 at 220° C.

TABLE 4

PDSC Results in Polyol Ester Oil Formulation

| Blend | Antioxidant (wt %) | Antioxidant (wt %) | Temp. ° C. | OIT min. |
|---|---|---|---|---|
| 6 | Naugalube 640 (1.0) | — | 220 | 24.1 |
| 7 | Naugalube 640 (0.75) | Naugalube TMQ (0.25) | 220 | 31.0 |
| 8 | Naugalube 640 (0.50) | Naugalube TMQ (0.50) | 220 | 36.1 |
| 9 | Naugalube 640 (0.25) | Naugalube TMQ (0.75) | 220 | 47.0 |
| 10 | — | Naugalube TMQ (1.0) | 220 | 45.4 |
| 11 | Naugalube 640 (2.0) | — | 220 | 28.2 |
| 12 | Naugalube 640 (1.0) | Naugalube TMQ (1.0) | 220 | 58.9 |
| 13 | Naugalube 640 (0.50) | Naugalube TMQ (1.50) | 220 | 63.5 |
| 14 | — | Naugalube TMQ (2.0) | 220 | 59.5 |

The data in Table 4 were generated in a polyol ester base oil (Hatcol 1754, Hatco Corporation). The secondary arylamine tested was a complex mixture of octylated and butylated diphenylamines (Naugalube® 640, Uniroyal Chemical Company, Inc.). The 2,2,4-trimethyl-1,2-dihydroquinoline oligomer tested is available commercially from Uniroyal Chemical Company, Inc., and is sold as Naugalube TMQ. The OIT measurements of blends 6 to 10 were tested with 1 weight percent total antioxidant. Blend 9 demonstrates the superior oxidation stability of mixtures of the two antioxidants. The OIT measurements of blends 11 to 14 were tested with 2 weight percent total antioxidant. Blend 13 demonstrates the superior oxidation stability of mixtures of the two antioxidants. Each blend was tested under the conditions described in Table 2 at 220° C.

TABLE 5

PDSC Results in SAE 10W-30 Passenger Car Motor Oil (PCMO) Formulation Blended with API Group I Base Oil

| Blend | Antioxidant (wt %) | Antioxidant (wt %) | Temp. ° C. | OIT min. |
|---|---|---|---|---|
| 15 | Naugalube 640 (1.0) | — | 175 | 98.1 |
| 16 | Naugalube TMQ (0.75) | Naugalube 640 (0.25) | 175 | 133.9 |
| 17 | Naugalube TMQ (0.25) | Naugalube 640 (0.75) | 175 | 107.9 |
| 18 | Naugalube TMQ (1.0) | — | 175 | 98.5 |

The data in Table 5 were generated in a fully formulated PCMO made with API Group I base oil (Exxon LP 100 and 150). The PCMO contained the typical additives as described above. The secondary arylamine tested was a complex mixture of octylated and butylated diphenylamines (Naugalube® 640, Uniroyal Chemical Company, Inc.). The 2,2,4-trimethyl-1,2-dihydroquinoline oligomer tested is available commercially from Uniroyal Chemical Company, Inc., and is sold as Naugalube TMQ. The OIT measurements of blends 15 to 18 were tested with 1 weight percent total antioxidant. Blends 16 and 17 demonstrate the superior oxidation stability of mixtures of the two antioxidants. Each blend was tested under the conditions described in Table 2 at 175° C.

TABLE 6

PDSC Results in SAE 10W-30 Passenger Car Motor Oil (PCMO) Formulation Blended with API Group II Base Oil

| Blend | Antioxidant (wt %) | Antioxidant (wt %) | Temp. ° C. | OIT min. |
|---|---|---|---|---|
| 19 | Naugalube 640 (1.0) | — | 175 | 155.8 |
| 20 | Naugalube 640 (0.5) | Naugalube TMQ (0.5) | 175 | 186.5 |
| 21 | Naugalube 640 (0.25) | Naugalube TMQ (0.75) | 175 | 165.1 |
| 22 | Naugalube 640 (0.75) | Naugalube TMQ (0.25) | 175 | 209.9 |
| 23 | — | Naugalube TMQ (1.0) | 175 | 135.5 |

The data in Table 6 were generated in a fully formulated PCMO made with API Group II base oil (Chevron 100R and 240R). The PCMO contained the typical additives as described above. The secondary arylamine tested was a complex mixture of octylated and butylated diphenylamines (Naugalube® 640, Uniroyal Chemical Company, Inc.). The 2,2,4-trimethyl-1,2-dihydroquinoline oligomer tested is available commercially from Uniroyal Chemical Company, Inc. and is sold as Naugalube TMQ. The OIT measurements of blends 19 to 23 were tested with 1 weight percent total antioxidant. Blends 20, 21, and 22 demonstrate the superior oxidation stability of mixtures of the two antioxidants. Each blend was tested under the conditions described in Table 2 at 175° C.

In view of the many changes and modifications that can be made without departing from principles underlying the invention, reference should be made to the appended claims for an understanding of the scope of the protection to be afforded the invention.

What is claimed is:

1. A composition comprising lubricating oil selected from the group consisting of polyol esters, diesters, phthalate esters, trimellitate esters, pyromellitate esters, dimer acid esters, and polyoleates and a mixture of antioxidants, said mixture consisting of from about 0.01 to about 10 weight percent of a first antioxidant and from about 0.01 to about 10 weight percent of a second antioxidant, the first antioxidant being a secondary diarylamine of the formula $R_1$—NH—$R_2$ where $R_1$ and $R_2$ each independently represent a substituted or unsubstituted aryl group having from 6 to 46 carbon atoms and the second antioxidant being a 2,2,4-trialkyl-1,2-dihydroquinoline or a polymer thereof of the structure:

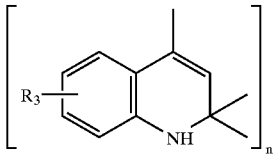

where n=1–1000 and $R_3$ is hydrogen, alkyl, or alkoxy; and wherein the ratio of the first antioxidant to the second antioxidant is from 1:99 to 99:1.

2. The composition of claim 1 wherein the first antioxidant is selected from the group consisting of diphenylamine, monoalkylated diphenylamine, dialkylated diphenylamine, trialkylated diphenylamine, or mixtures thereof, 3-hydroxydiphenylamine, 4-hydroxydiphenylamine, mono- and/or di-butyldiphenylamine, mono- and/or di-octyldiphenylamine, mono- and/or di-nonyldiphenylamine, phenyl-α-naphthylamine, phenyl-β-naphthylamine, diheptyldiphenylamine, mono- and/or di-(α-methylstyryl)diphenylamine, mono- and/or distyryldiphenylamine, 4-(p-toluenesulfonamido) diphenylamine, 4-isopropoxydiphenylamine, t-octylated N-phenyl-1-naphthylamine, mixtures of mono- and dialkylated t-butyl-t-octyldiphenylamines, N-phenyl-1,2-phenylenediamine, N-phenyl-1,4-phenylenediamine, N,N'-diphenyl-p-phenylenediamine, N,N'-di(naphthyl-2)p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, and N-cyclohexyl-N'-phenyl-p-phenylenediamine.

3. The composition of claim 1 wherein the second antioxidant is 2,2,4-trimethyl-1,2-dihydroquinoline or a polymer thereof.

4. The composition of claim 1 further comprising at least one additional additive selected from the group consisting of dispersants, detergents, rust inhibitors, metal deactivators, antiwear agents, antifoamants, friction modifiers, seal swell agents, demulsifiers, viscosity index improvers, and pour point depressants.

5. A method of increasing the oxidation stability of a lubricating oil selected from the group consisting of polyol esters, diesters, phthalate esters, trimellitate esters, pyromellitate esters, dimer acid esters, and polyoleates comprising adding thereto a composition comprising a mixture consisting of from about 0.01 to about 10 weight percent of a first antioxidant and from about 0.01 to about 10 weight percent of a second antioxidant, the first antioxidant being a secondary diarylamine of the formula $R_1$—NH—$R_2$ where $R_1$ and $R_2$ each independently represent a substituted or unsubstituted aryl group having from 6 to 46 carbon atoms and the second antioxidant being a 2,2,4-trialkyl-1,2-dihydroquinoline or a polymer thereof of the structure:

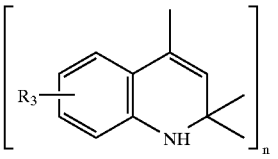

where n=1–1000 and $R_3$ is hydrogen, alkyl, or alkoxy.

6. The method of claim 5 wherein the first antioxidant is selected from the group consisting of diphenylamine, monoalkylated diphenylamine, dialkylated diphenylamine, trialkylated diphenylamine, or mixtures thereof, 3-hydroxydiphenylamine, 4-hydroxydiphenylamine, mono- and/or di-butyldiphenylamine, mono- and/or di-octyldiphenylamine, mono- and/or di-nonyldiphenylamine, phenyl-α-naphthylamine, phenyl-β-naphthylamine, diheptyldiphenylamine, mono- and/or di-(α-methylstyryl)diphenylamine, mono- and/or distyryldiphenylamine, 4-(p-toluenesulfonamido) diphenylamine, 4-isopropoxydiphenylamine, t-octylated N-phenyl-1-naphthylamine, mixtures of mono- and dialkylated t-butyl-t-octyldiphenylamines, N-phenyl-1,2-phenylenediamine, N-phenyl-1,4-phenylenediamine, N,N'-diphenyl-p-phenylenediamine, N,N'-di(naphthyl-2)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, and N-cyclohexyl-N'-phenyl-p-phenylenediamine.

7. The method of claim 5 wherein the second antioxidant is 2,2,4-trimethyl-1,2-dihydroquinoline or a polymer thereof.

8. The method of claim 5 wherein the ratio the first antioxidant to the second antioxidant is from 1:99 to 99:1.

9. The method of claim 5 wherein the composition further comprises at least on additional additive selected from the group consisting of dispersants, detergents, rust inhibitors, metal deactivators, antiwear agents, antifoamants, friction modifiers, seal swell agents, demulsifiers, viscosity index improvers, and pour point depressants.

* * * * *